United States Patent [19]

Howe

[11] Patent Number: 5,039,017

[45] Date of Patent: Aug. 13, 1991

[54] PORTABLE TEXTURING MACHINE

[76] Inventor: David Howe, P.O. Box 652, Oracle, Ariz. 85623

[21] Appl. No.: 360,776

[22] Filed: Jun. 2, 1989

[51] Int. Cl.[5] ..... B05B 7/12

[52] U.S. Cl. ..... 239/346; 239/375; 406/38; 406/146; 222/637

[58] Field of Search ..... 239/345, 346, 376, 337, 239/375; 406/38, 145, 146, 151, 152, 153, 128, 192; 222/637, 129.2, 133

[56] References Cited

U.S. PATENT DOCUMENTS

| | | | |
|---|---|---|---|
| 1,331,465 | 2/1920 | Barrett | 239/345 |
| 1,730,195 | 10/1929 | Davis | 406/153 |
| 1,835,603 | 12/1931 | Kincaid, Jr. | 406/153 |
| 2,305,269 | 12/1942 | Moreland | 239/345 |
| 2,982,582 | 5/1961 | Tilney | 406/144 |
| 3,062,415 | 11/1962 | Anderson | 239/397 |
| 3,180,578 | 4/1965 | Hagadorn | 239/346 |
| 3,236,459 | 2/1966 | McRitchie | 239/376 |
| 3,442,454 | 5/1969 | Stenger et al. | 239/346 |
| 3,690,563 | 9/1972 | Farrington et al. | 239/346 |
| 3,892,607 | 7/1975 | Schlottmann et al. | 239/345 |
| 4,502,640 | 3/1985 | Nonis | 239/346 |
| 4,561,808 | 12/1985 | Spaulding et al. | 406/144 |
| 4,863,104 | 9/1989 | Masterson | 239/345 |

FOREIGN PATENT DOCUMENTS

| | | | |
|---|---|---|---|
| 489541 | 1/1930 | Fed. Rep. of Germany | 406/128 |
| 479904 | 4/1953 | Italy | 239/345 |

*Primary Examiner*—Andres Kashnikow

*Assistant Examiner*—Christopher G. Trainor

*Attorney, Agent, or Firm*—Don J. Flickinger; Jordan M. Meschkow

[57] ABSTRACT

A portable texturing system is disclosed which includes a small spray unit and a source of portable compressed air which may simply be a small tank which the workman may wear on a belt or shoulder harness. The spray unit includes a reservoir for holding a charge of texturizing mixture and a cap assembly incorporating a mixer/spray mechanism. In use, the cap is positioned below the reservoir such that the texturizing mixture can flow by gravity and suction to the spray mechanism. The cap assembly includes a quick connect coupling and a valve for receiving and controlling air from the supply. A discharge nozzle is provided for directing the compressed air/texturizer mixture toward a wall area to be texturized. A mixing region within the cap assembly permits the texturizing mixture to be entrained with a stream of compressed air and discharged from the nozzle whenever the valve is actuated. Adjustment structure for regulating the rate at which the texturizing material is entrained is provided in the mixing region and, in some embodiments, is adjustable as by a mechanism which provides adjustment to the area available for the texturizing material to enter the discharge nozzle. In one particularly simple and reliable embodiment, the area is established by the provision of a pair of fixed size apertures in the wall of a tube which also serves as the discharge nozzle.

8 Claims, 3 Drawing Sheets

FIG. 10
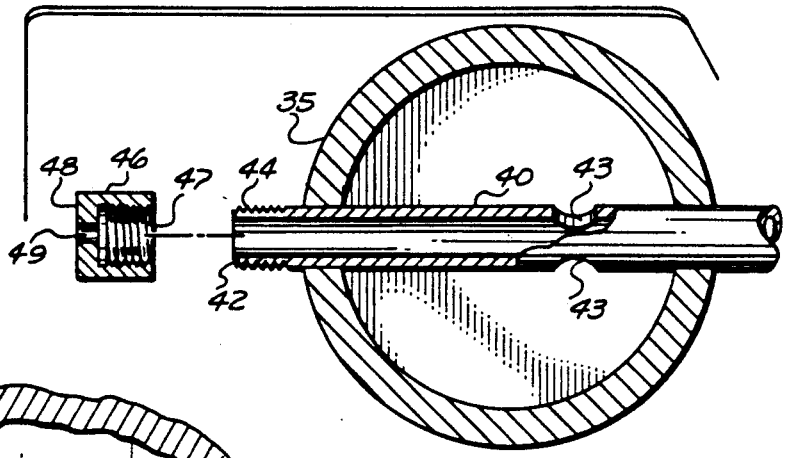
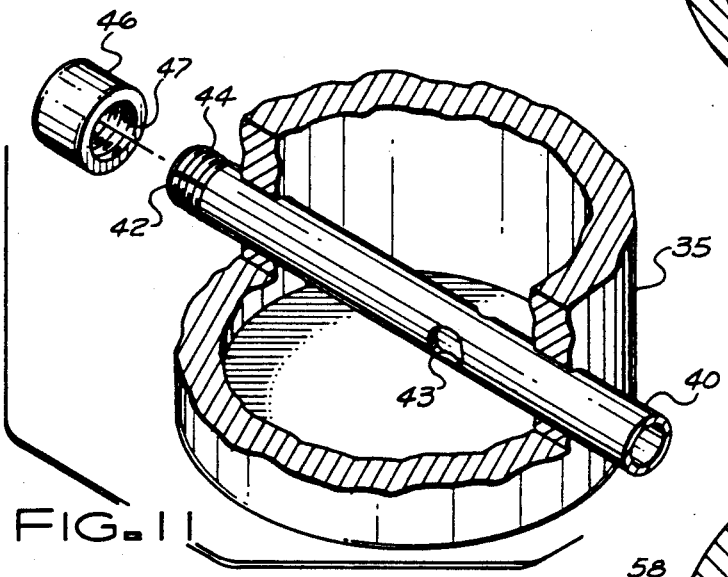
FIG. 11
FIG. 12
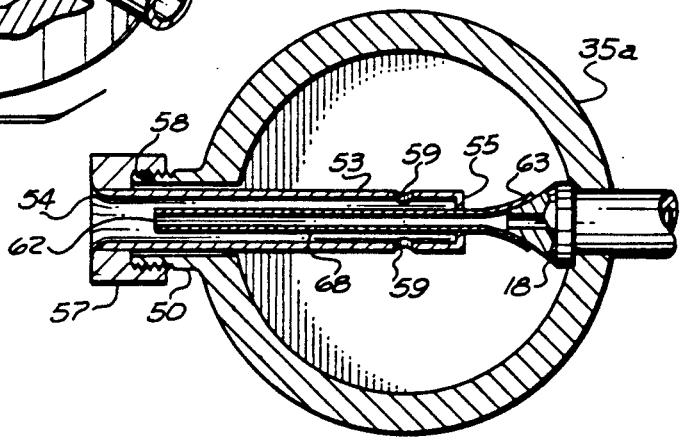
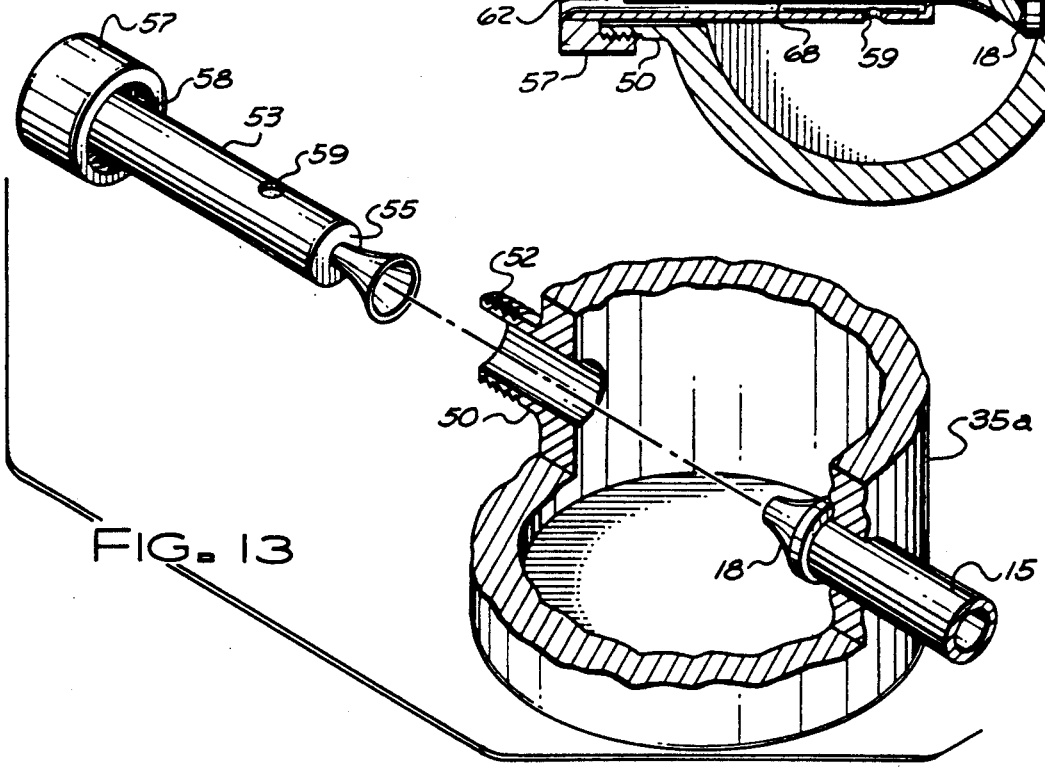
FIG. 13

PORTABLE TEXTURING MACHINE

FIELD OF THE INVENTION

This invention relates to the building construction arts and, more particularly, to a portable machine for applying a texturized finish to interior drywall surfaces.

BACKGROUND OF THE INVENTION

In the method of construction in which the interior walls are fabricated from wallboard, the wallboard is frequently finished by a textured layer to provide the appearance of a plastered wall. The texturing is accomplished by spraying a special preparation upon the smooth surface of the wallboard, and this process is carried out using large, expensive equipment appropriate for texturizing an entire room or house. However, as those in the art are aware, there has been no lightweight portable texturizing apparatus for attending to patch and repair work to a texturized wall. As a result, texturized walls needing touchup or repair have often been left in their somewhat unsightly and unpleasing state since the economics of effecting such touchup of repair have been prohibitive unless there is a great deal of such work to do. Occasionally, touchup or repair of texturized walls is attempted using spackling compound or the like in which an a speculative effort is made to work a matching texturized finish into the still fluid compound. While sometimes achieving acceptable results, such attempts are very laborious and rarely result in touchup or repair which can stand close inspection.

Thus, it will be apparent to those skilled in the art that it would be highly desirable to provide a true texturizing system which is genuinely portable, lightweight and easy to use, and it is to these ends that my invention is directed.

OBJECTS OF THE INVENTION

It is therefore a broad object of my invention to provide a portable texturizing unit for finishing or refinishing wallboards covered with textured material.

It is another object of my invention to provide such a unit which is lightweight and easy to handle and use.

It is yet another object of my invention to provide such a unit which, in various embodiments, includes adjustment structure for regulating the rate at which viscous fluid texturizing material is delivered from a reservoir and mixed with air under pressure to obtain the desired spray characteristics.

In an alternative embodiment, it is another object of may invention to provide such a unit in which the adjustment structure is simple and includes no moving parts.

It is still another object of my invention to provide such a unit further including for selectively varying the pattern in which the texturizing material is sprayed.

It is yet still another object of my invention to provide such a unit which includes an attachment to adapt the unit for spraying non-viscous material.

It is a still yet further object of my invention to provide such a unit which, in all embodiments, is economical to fabricate and which has a long life in service.

SUMMARY OF THE INVENTION

Briefly, these and other objects of my invention are achieved by a portable texturing system which includes a small spray unit and a source of portable compressed air which may simply be a small tank which the workman may wear on a belt or shoulder harness. The spray unit includes a reservoir for holding a charge of texturizing mixture and a cap assembly incorporating a mixer/spray mechanism. In use, the cap is positioned down such that the texturizing mixture can flow by gravity and suction to the spray mechanism. Preferably, the reservoir has a removable cover at its other end to permit recharging the unit without the necessity for removing the cap assembly. The cap assembly includes a quick connect coupling for receiving an air hose from the compressed air supply and a valve for selectively applying and interrupting the supply of compressed air to the unit. Diametrically oppositely directed from the air supply structure, there is provided a nozzle for discharging the compressed air/texturizer mixture toward a wall area to be texturized. A mixing region within the cap assembly permits the texturizing mixture to be entrained with a stream of compressed air admitted into the cap assembly and discharged from the nozzle whenever the valve is actuated. Adjustment structure for regulating the rate at which the texturizing material is entrained is provided in the mixing region and, in some embodiments, is adjustable as by a mechanism which provides corresponding adjustment to the area available for the texturizing material to enter the discharge nozzle.

Further included in the texturizing system are selectively variable spray control means for discharging the texturizer mixture in a predetermined pattern. In a preferred embodiment, the spray control means includes a tip which is detachably securable to the nozzle. A discharge orifice extending through the tip has a configuration chosen to discharge a predetermined pattern. Also included is an attachment especially adapted for converting the system for spraying non-viscous material. The adapter includes an outer tube coaxially receivable within the discharge nozzle and having at least one aperture therethrough within the region of the cap. An inner tube, coaxially carried within the outer tube, has a discharge end spaced inboard of the discharge end of the outer tube and an inlet end for receiving compressed air from the air supply structure. The attachment is detachably securable to the discharge nozzle.

DESCRIPTION OF THE DRAWING

The subject matter of the invention is particularly pointed out and distinctly claimed in the concluding portion of the specification. The invention, however, both as to organization and method of operation, may best be understood by reference to the following description take in conjunction with the subjoined claims and the accompanying drawing of which:

FIG. 10 is a view generally similar to the illustration of FIG. 10 and showing another embodiment of the instant invention including a structure for selectively varying the spray pattern;

FIG. 11 is a fragmentary perspective view of the embodiment of FIG. 10;

FIG. 12 is an illustration generally similar to the view of FIG. 10 and showing yet another embodiment of the invention including attachment structure especially adapted for spraying non-viscous material; and FIG. 13 is an exploded fragmentary perspective view of the embodiment of FIG. 12.

DETAILED DESCRIPTION OF THE INVENTION

Figure 1:
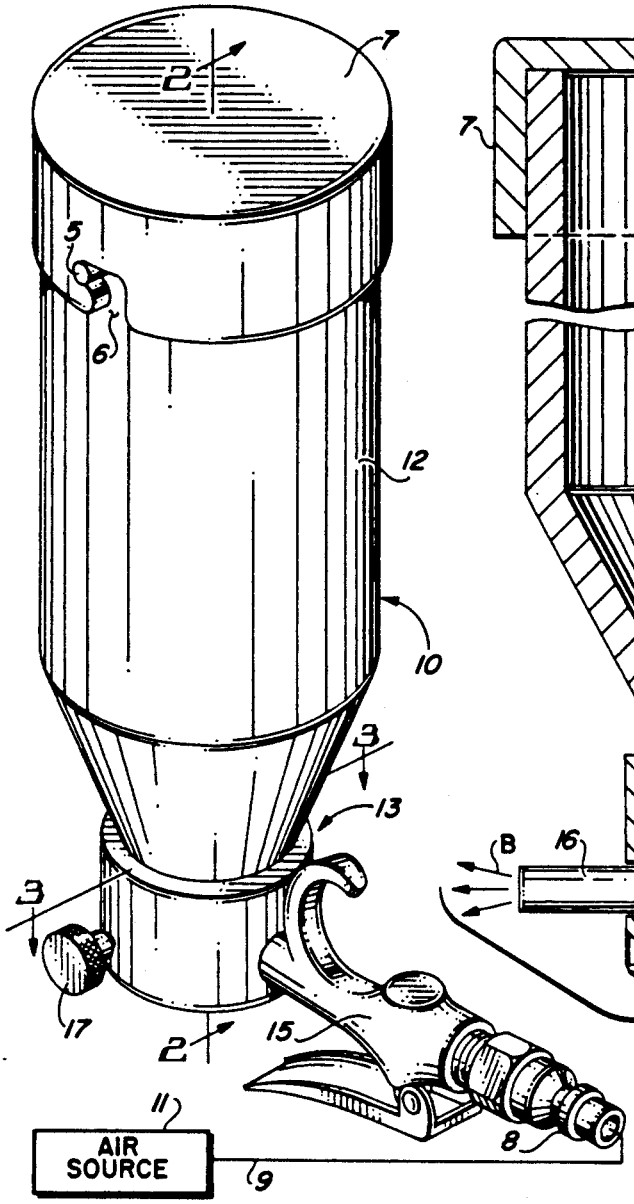
FIG. 1 is a exterior perspective view of one embodiment of a spray unit according to the invention.

Referring now to FIG. 1, the exterior appearance of one embodiment of the spray unit 10 according to the invention is shown. A source 11 of compressed air may take any convenient form such as a small tank which the workman may wear on a belt or shoulder harness. The source 11 of compressed air may be coupled to the spray unit 10 by a hose 9 in the conventional fashion, preferably at a quick connect 8 integrated with a manually actuable valve 15. A discharge nozzle 16 extends from an entry end Within the cap assembly 13 to a discharge end outside the cap and situated diametrically opposite the air inlet. A control adjusting knob 17 is employed to adjust the spray mixture as will be described more fully below. A removeable cover 7 permits charging the reservoir 12 with a load of texturizing material, and one convenient securing arrangement for removably affixing the cover 7 to the reservoir 12 is by the use of bayonet slots 6 in opposing positions on the cover 7 in cooperation with appropriately positioned outwardly directed pins 5 fixed to the walls of the reservoir 12.

Attention is now directed also to FIGS. 2, 3, 4 and 5 in which it can be seen that an air stream passing from air nozzle 18 in the direction of arrowed line A (FIG. 2) passes through a free space before entering the inlet of discharge nozzle 16. As a result of the inverted position of the reservoir 12, texturizer material within the reservoir settles by gravity (and, during actual operation, also somewhat under the influence of the suction obtained through the Bernoulli effect) into the interior of the cap assembly 13 around the air nozzle 18 and the discharge nozzle 16. Accordingly, the texturing material is entrained into the air stream to be discharged in a spray represented by the arrowed lines B. The concentration of texturing material, and hence the pattern produced upon the wall area, is a direct result of the area across which the texturing material has access to the air stream which is, in turn, a direct result of the distance between the inlet of discharge nozzle 16 and the air nozzle 18.

Figure 2:
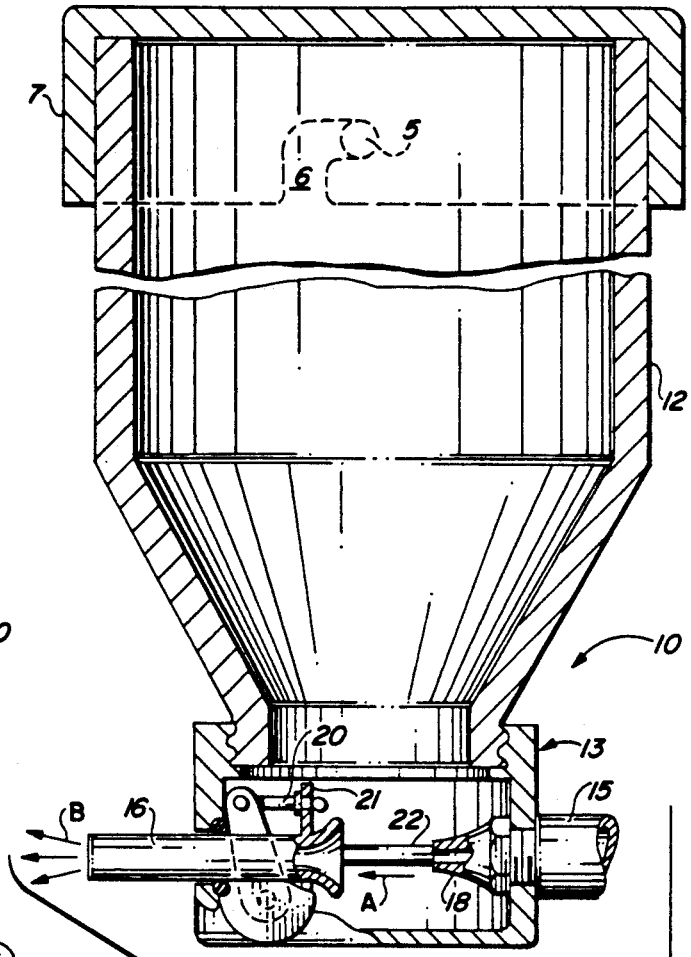
FIG. 2 is a cross sectional view taken along the lines 2—2 of FIG. 1 and illustrates certain internal adjustment structure of the mixing region in the cap assembly of the spray unit disposed in a first extreme position.
Figure 3:
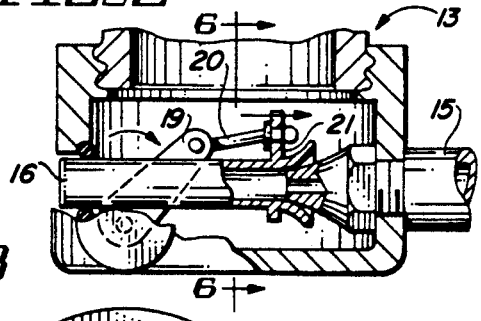
FIG. 3 is a view similar to the bottom portion of FIG. 2 and illustrates the internal adjustment structure in a second extreme position.
Figure 4:
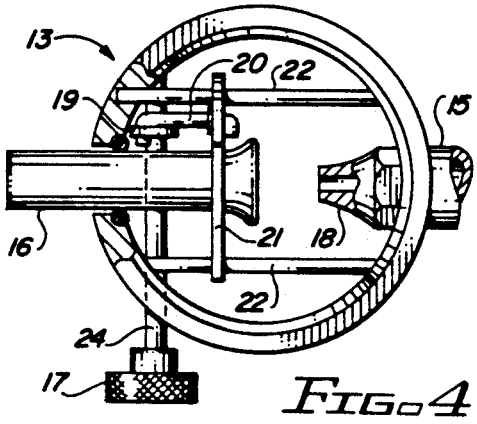
FIG. 4 is a cross sectional view taken along the lines 4—4 of FIG. 1 and represents a top view of the adjustment structure configured in its first extreme position as in FIG. 2.
Figure 5:
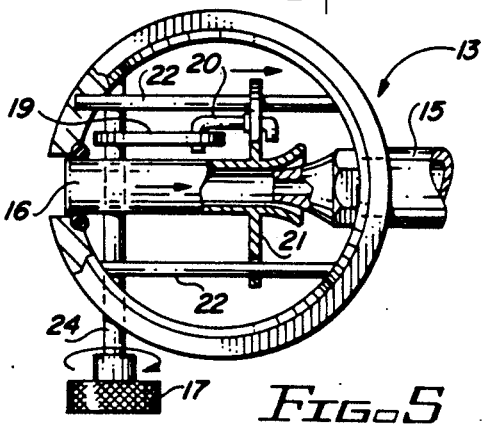
FIG. 5 is a view similar to FIG. 4 showing a top view of the adjustment structure configured in its second extreme position as in FIG. 3.
Figure 6:
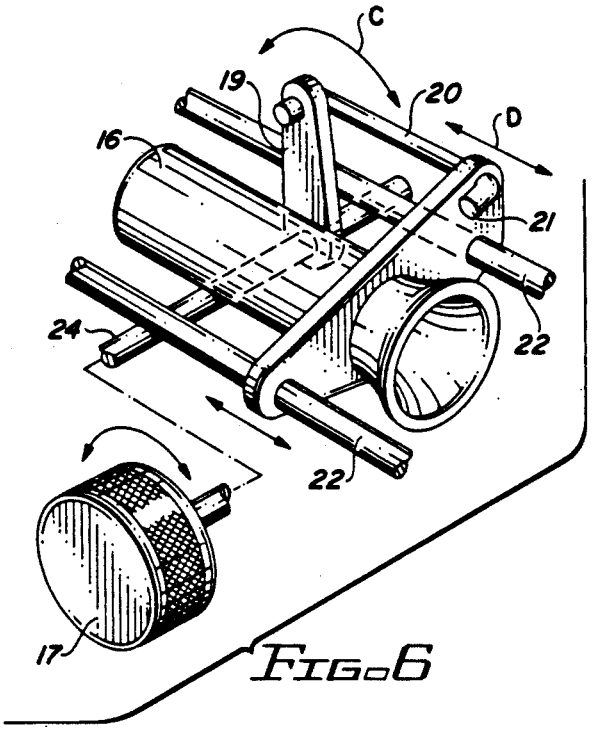
FIG. 6 is a broken away isolated view of certain components of the adjustment structure showing their operative relationships.

FIGS. 2 and 4 illustrate the extreme position of the adjustment structure in which the highest concentration of texturing material is entrained into the air stream whereas FIGS. 3 and 5 illustrate the extreme position of the adjustment structure in which the lowest concentration of texturing material is entrained. Referring also to FIG. 6, the manner in which the adjustment structure may be set to these two extreme positions and all intermediate positions will now be discussed. Turning control adjustment knob 17 causes axle 24 to turn and an arm 19 (which has its inboard end fixed to the axle) to pivot through an identical arc represented by double-ended arrow C in FIG. 6. A link 20 is pivotally connected at a first end to the outboard end of arm 19 and at a second end to slide member 21 which is fixed to discharge nozzle 16 near its inlet and supports the discharge nozzle in that region. As best seen in FIGS. 4, 5 and 6, slide member 21 is, in turn, slideably supported by elongated guides 22 positioned generally parallel to and offset from the axis formed by the air nozzle 18 and the discharge nozzle 16. Thus, by turning control adjusting knob 15 in first one direction and then the other, the discharge nozzle may be moved longitudinally between its extreme axial positions (as represented by the double-ended arrow D in FIG. 6) to change the area available for the texturizer to enter the air stream and accordingly change the concentration of texturizer material in the spray delivered from the discharge nozzle.

Figure 7:
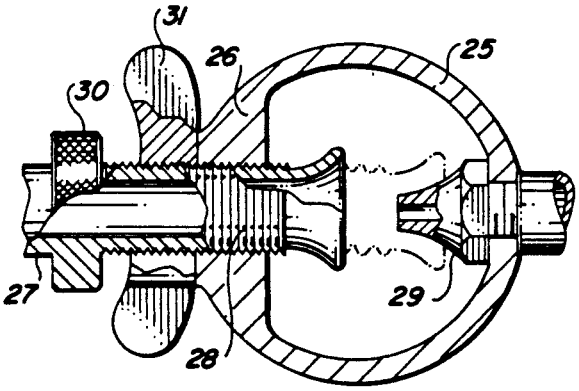
FIG. 7 is a top view of a second embodiment of the adjustment structure.

The skilled workman will appreciate that the range of texturizer concentration in the airstream which obtains the desired characteristics of the spray issued from the discharge nozzle is relatively constant and predictable given a particular texturizer, a particular air source operating at a known pressure and a given spray unit. It is therefore possible to provide a somewhat simpler spray adjustment which need only be occasionally set and locked. An embodiment of the invention directed to one such arrangement is illustrated in FIG. 7. In this embodiment, the cap 25 includes a thickened wall region 26 through which an internally threaded aperture extends. The discharge nozzle 27 includes an externally threaded portion 28 which may be selectively threaded into the thickened wall region 26. Consequently, the position of the inlet to the discharge nozzle 27 with respect to the air nozzle 29 may readily adjusted to suit the workman by turning the discharge nozzle, as by using an integral knurled knob 30, to establish the desired spray characteristics. Preferably, the discharge nozzle is then locked into this selected longitudinal position by screwing a lock nut 31 against the outer surface of the thickened wall region 26 of the cap 25, the locknut being threaded onto the portion 28 intermediate the knurled knob 30 and the cap.

Figure 8:
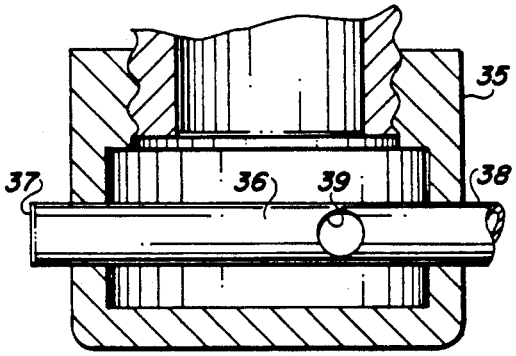
FIG. 8 is a cross section side view, similar to FIGS. 2 and 4, of a third embodiment of the adjustment structure in an embodiment of the invention which is particularly simple and reliable.
Figure 9:
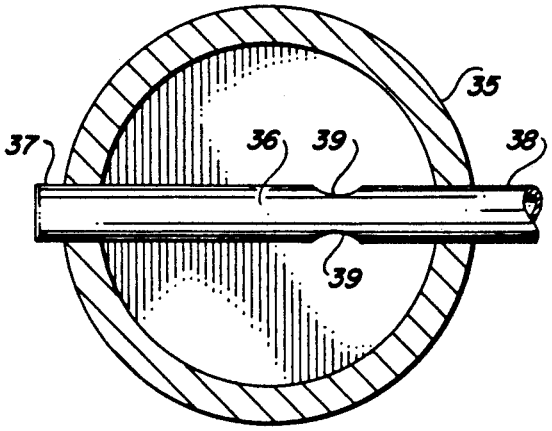
FIG. 9 is a top view, similar to FIGS. 3 and 5, of the third embodiment of the adjustment structure.

It has been found that, with standardized components, a well adjusted spray unit may be achieved with the elegantly simple adjustment structure illustrated in FIGS. 8 and 9. In this embodiment, the tube 36 is fixed within the cap 35, and the outboard end 37 of the tube serves as the fixed position discharge nozzle while compressed air enters from the other tube end 38 which may be coupled to a valve and quick connect as previously described. Intermediate the length of the tube 36 within the cap 35, a pair of diametrically opposed apertures 39 are provided to permit texturizer to be entrained within a stream of compressed air passing through the tube.

The size of the apertures 39 is determined by the characteristics of the remainder of the components, the texturizer and the air pressure available. Once the size of the apertures 39 is established, repeatable performance is obtained so long as the other potential variables are maintained within reasonable ranges. As a practical matter, it has been found that a good deal of variability can be accommodated such that one cap assembly (or perhaps two or three cap assemblies with different sized apertures 39) are adequate for most or all jobs. Merely by way of example, for a tube 36 which has an outside diameter of about three-eighths inch, apertures 39 on the order of one-fourth inch provide good performance over a fairly wide range of conditions.

The texturizing material is sprayed from the discharge nozzle in a characteristic pattern. Pattern, as used herein, refers to the cross-sectional shape of the spray and the cross-sectional measurement at any given distance from the nozzle. The pattern is controlled by the cross-sectional shape and dimension of the discharge nozzle. The tubular discharge nozzles described in connection with the foregoing embodiments of the invention emit a pattern that is round and of substantial cross-sectional dimension. Contemplated by the invention are means for selectively varying the pattern.

Referring now to FIGS. 10 and 11 there is illustrated simple yet exceedingly effective spray control structure for spraying the texturizer material in a predetermined pattern. Seen is tube 40 fixed within end cap 35 and having outboard end 42 and apertures 43. To the foregoing extent, tube 40 is analogous to previously described tube 36. That is, apertures 43 permit texturizer to be entrained within a stream of compressed air passing through the tube 40 and outboard end 42 normally functions as the fixed position discharge nozzle. Tube 40 differs from tube 36 by virtue of external threads carried along a terminal portion adjacent outboard end 42.

A tip 46 having internally threaded bore 47 and end wall 48 is detachably securable to tube 40 by virtue of engagement between threaded bore 47 and the threaded terminal portion 44. Discharge orifice 49 extends through end wall 48. The pattern of spray corresponds to the configuration of orifice 49. For example, an orifice which is circular in cross-section emit a spray which is circular in cross-section. Similarly, an orifice that is ovate in cross-section will emit a pattern that is ovate in cross-section. The cross-sectional dimension of the pattern is directly proportional to the cross-sectional dimension of the orifice. A plurality of tips each having an orifice of predetermined configuration may be made available for convenient use of the workman. While tip 46 was chosen for purposes of illustration in combination with the embodiment of the invention previously described in FIGS. 8 and 9, it will be appreciated by those skilled in the art that the principles of the immediate embodiment are readily adaptable to the other previously described embodiments of the invention.

Structure especially adapted for converting the previously described embodiments of the instant invention for spraying a non-viscous material, such as paint, will now be described with reference to FIGS. 12 and 13. For simplicity of illustration there is seen a cap 35*a*, the previously described cap 35 having been modified by the inclusion of integrally formed discharge nozzle 50 having externally threaded terminal portion 52. Valve 15 terminating with air nozzle 18 and carried by cap 35A as previously described, is diametrically opposed to discharge nozzle 50.

The attachment includes an elongate outer tube 53 coaxially receivable through nozzle 50 and including outboard end 54 and inboard end 55. Outboard end 54 functions as the discharge end. Inboard end 55, which is closed, is directed toward air nozzle 18. Tip 57 affixed to tube 53 proximate outboard end 54 includes internally threaded bore 58 which is concentric with tube 53 and removably engageable with the terminal portion 52 of nozzle 50. A pair of diametrically opposed apertures 59 extend through tube 53 to reside within cap 35. Inner tube 68, coaxially residing within outer tube 53 extends between a discharge end 62 and inlet end 63. Discharge end 62 is spaced inboard of the outboard end 54 of outer tube 53. Inlet end 53 projects beyond the inboard end 55 of inner tube 53. Intermediate the ends, inner tube 68 passes through inboard end 55. Tube 68 is affixed to end 55 by any convenient well known means such as crimping or sodering.

Inlet end 63 of inner tube 68 functions to receive pressurized air from the respective source. In the embodiment chosen for purposes of illustration, which is analogous to the embodiments seen in FIGS. 1–7, inlet end 63 is flared to mate with the frustoconical air nozzle. For use in combination with the embodiments seen in FIGS. 8–12, inlet end 63 could be sized to have an outside diameter to be sealingly received within the respective tube. The use of a seal, such as a conventional O-ring, may also be incorporated for sealing purposes.

As will be appreciated by those skilled in the art, openings 59 are sized in proportion to the flow rate of the non-viscous material. Air passing through inner tube 68 draws the material into outer tube 58 through openings 59. The air and the material are mixed within outer tube 53 intermediate the end 54 thereof and the end 62 of inner tube 68 to be sprayed in a manner analogous to that provided by a conventional spray painting apparatus.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

I claim:

1. A spray device comprising:

a) a reservoir for containing a charge of relatively viscous wall texturizing material or a charge of relatively non-viscous paint;

b) a cap removably fitted on a bottom of said reservoir, an interior of said cap being in direct communication with an interior of said reservoir in order that the material tends to gravity flow into said cap interior;

c) a discharge nozzle suitable for discharging said relatively viscous texturizer material, said discharge nozzle including an entry end disposed within said cap, a discharge end projecting outwardly of said cap, and a bore extending between said entry end and said discharge end;

d) an air nozzle for discharging compressed air within said cap, said air nozzle being aligned with said entry end of said discharge nozzle; and e) an adapter for removable placement in said cap to convert the device from a first configuration suitable for spraying said relatively viscous wall texturizing material to a second configuration suitable for spraying said relatively non-viscous paint, said adapter including i) an outer tube coaxially receivable within the bore of said discharge nozzle and having a discharge end, an inboard end directed toward said air nozzle, and at least one aperture formed intermediate said discharge end and said inboard end for admitting material from said reservoir;

ii) an inner tube coaxially carried within said outer tube and including a discharge end disposed between said at least one aperture and said discharge end of said outer tube, and an inlet end for receiving compressed air from said nozzle; and iii) attachment means for detachably securing said outer tube to said discharge nozzle.

2. A device according to claim 1, wherein said inboard end of said outer tube is closed, and said inner tube extends through said closed inboard end.

3. A device according to claim 1, wherein said at least one aperture comprises a pair of apertures formed on diametrically opposite locations on said outer tube.

4. A device according to claim 2, wherein said at least one aperture comprises a pair of apertures formed on diametrically opposite locations on said outer tube.

5. An adapter for removable placement in a spray device to convert the device from a first configuration suitable for spraying relatively viscous wall texturizing material to a second configuration suitable for spraying relatively non-viscous paint, the device including a reservoir for containing a charge of one of said materials;

a discharge nozzle suitable for discharging said relatively viscous texturizer material, said discharge nozzle being coupled to said reservoir proximate the bottom end thereof and including an entry end disposed within said reservoir, a discharge end projecting outwardly of said reservoir, and a bore extending between said entry end and said discharge end, and an air nozzle for discharging compressed air within said reservoir, said air nozzle being aligned with said entry end of said discharge nozzle, said adapter comprising:

a) an outer tube coaxially receivable within the bore of said discharge nozzle and having i) a discharge end, ii) an inboard end directed toward said air nozzle, and iii) at least one aperture formed intermediate said discharge end and said inboard end for admitting material from said reservoir;

b) an inner tube coaxially carried within said outer tube and including i) a discharge end disposed between said at least one aperture and said discharge end of said outer tube, and ii) an inlet end for receiving compressed air from said nozzle; and c) attachment means for detachably securing said outer tube to said discharge nozzle.

6. An adapter according to claim 5, wherein said inboard end of said outer tube is closed, and said inner tube extends through said closed inboard end.

7. A device according to claim 5, wherein said at least one aperture comprises a pair of apertures formed on diametrically opposite locations on said outer tube.

8. A device according to claim 6, wherein said at least one aperture comprises a pair of apertures formed on diametrically opposite locations on said outer tube.

* * * * *